United States Patent [19]

Lemoine et al.

[11] Patent Number: 4,854,777

[45] Date of Patent: Aug. 8, 1989

[54] MECHANICAL CONNECTOR

[75] Inventors: Francois Lemoine, Nantes; René Rathouit, Saint Sebastien, both of France

[73] Assignee: Alsthom, Cedex, France

[21] Appl. No.: 143,536

[22] Filed: Jan. 13, 1988

[30] Foreign Application Priority Data

Jan. 13, 1987 [FR] France ..... 87 00272

[51] Int. Cl.[4] ..... E02B 17/02

[52] U.S. Cl. ..... 405/202; 403/330; 403/132; 405/224

[58] Field of Search ..... 405/195, 202, 224; 285/319, 320; 403/132, 326, 329, 330

[56] References Cited

U.S. PATENT DOCUMENTS 4,432,670 2/1984 Lawson ..... 405/224

4,439,055 3/1984 Quigg et al. ..... 405/202 X

*Primary Examiner*—David H. Corbin

*Attorney, Agent, or Firm*—Sughrue, Mion, Zinn, Macpeak & Seas

[57] ABSTRACT

Connector consists of a male connector part (40) linked to the tension line (6) and operable to penetrate a female receptacle part (1) being part of the anchoring point and having an upper necked portion ($\phi_2$) forming an internal circular shoulder (3). The connector comprising a cylindrical body (5) connected to the line and an internal cavity (10) whose cylindrical wall (16) is provided with a circular series of openings (11) to the outside. Each opening receives a dog (12) operable to assume a first, extended position projecting radially beyond the connector wall (16), radially abutting said wall and bearing upon the bottom surface of the opening (11) under the urging of a spring (14) and a second, retracted position during descent of the male connector part due to the pushing of the inclined bottom face (18) of the end of the dog against the mouth (4) of the female receptacle part. Each dog further has an inclined ramp (24) acting as a cam in cooperation with an operating pin (20) whose upward vertical displacement, by the pin pressing against and sliding along the ramp, retracts the dog. The pins are connected to a hub and spoke-like assembly operating on all pins simultaneously.

8 Claims, 8 Drawing Sheets

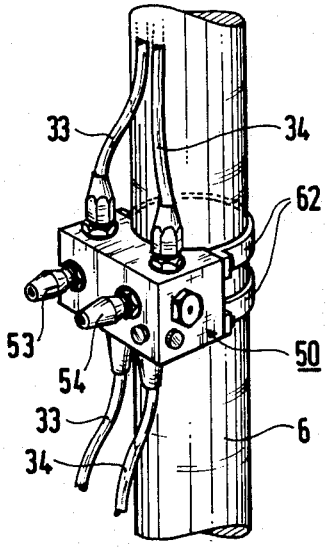
FIG. 10
FIG. 11
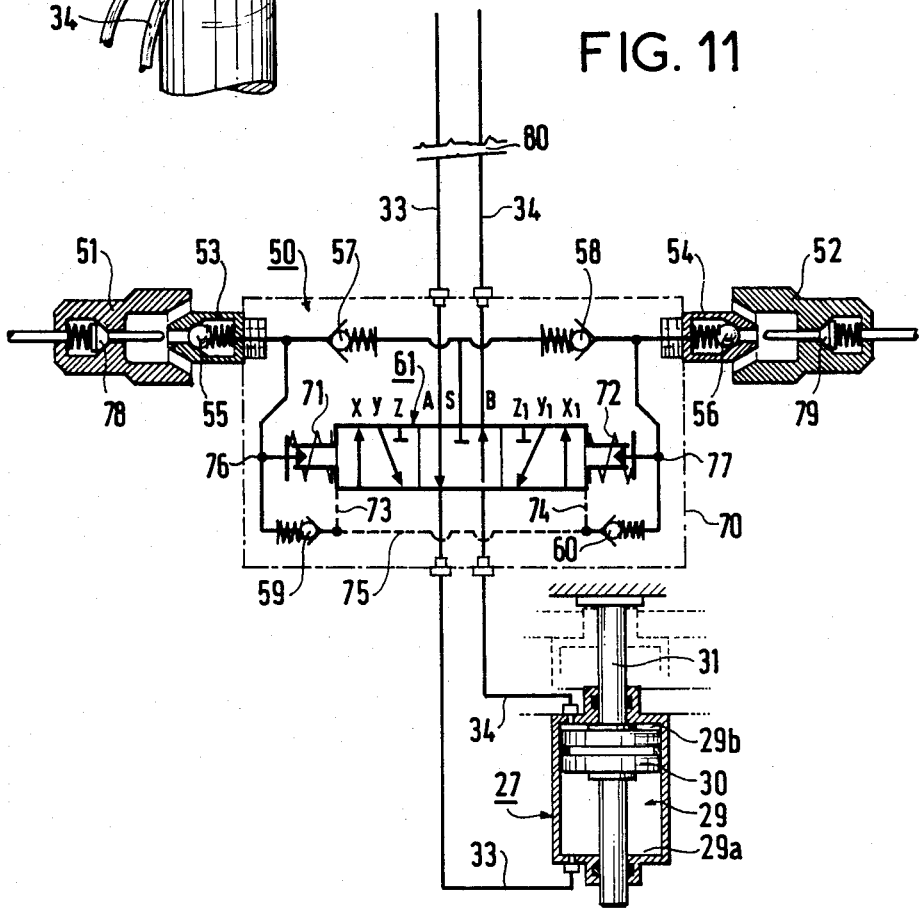

MECHANICAL CONNECTOR

FIELD OF THE INVENTION

This invention concerns a mechanical connector for securing a tether of a tension-leg platform to an anchoring point.

BACKGROUND OF THE INVENTION

There are numerous known mechanical connectors for the tension legs or tethers of tension-leg platforms. However, the known types are mechanically complex and often require that the connector bear against the bottom of the receptacle, which is undesirable in light of the difficulty of such a maneuver in swelling seas.

Document FR-A-No. 2573831 describes a mechanical connector that does not require pushing the connector against the bottom for connection. Nevertheless, that connector comprises a sliding ring which holds the latches in retracted position for penetration of the connector into the receptacle, the sliding ring thereof made to bear upon the top of the receptacle to release the latches inside the receptacle. If for any reason, for example the connector's hitting the receptacle's insertion cone, the sliding ring slides slightly, releasing the latches prior to penetration of the receptacle, these will open and the ring, in falling back, will block them in extended position, making receptacle penetration impossible. The only solution then is to pull the whole tether topside.

The object of this invention is to provide a mechanical connector with the simplest possible mechanical design that is also reliable in operation and does not require bearing against the bottom for connection.

SUMMARY OF THE INVENTION

The invention accordingly provides a mechanical connector for securing a tension-leg platform tether to an anchoring point, said connector consisting of a male connector linked to the tether and designed to penetrate a female receptacle made part of the anchoring point and having a necked upper portion forming a circular internal shoulder, said connector having a cylindrical body comprising means of connection to said tether, wherein said cylindrical body comprises an internal cavity the cylindrical wall whereof features a circular series of openings to the outside, each opening receiving a dog having at least a top face and a bottom face, said dog being operable to assume a first, extended position radially abutting the wall of said body and bearing upon the bottom surface of said opening, in which position it projects radially beyond the cylindrical outside wall of the connector and to which position it is urged by elastic, radially outthrusting means, a dogs' external inclined face sloping such that one moves away from the connector's centerline in moving up the said inclined face, said dog being operable to assume a second position, of automatic retraction during connector descent, by said inclined face's bearing against the top rim of the female receptacle, each dog further comprising an inclined ramp acting as a cam, in cooperation with a drive pin whose vertical upward motion, by said pin's pushing and sliding against said ramp, causes the dog to retract, all the pins being connected to means enabling their vertical displacement.

According to a preferred embodiment of the invention, the radially outthrusting elastic means for each dog include a spring leaf located inside the internal cavity of the connector body and attached on the one hand by its top end to a tail of the dog and on the other hand, by its bottom end, to the bottom of said cavity.

Advantageously, the means enabling vertical displacement of said pins include an axial operating stem going through the bottom of the cavity of said body and whose bottom projects beyond the bottom end of the connector, the top end of said stem being mechanically attached to said pins by hub and spoke-like connecting means operating on all the pins simultaneously.

The projection of said operating stem serves, due to its bearing upon the bottom of the receptacle, to retract the dogs and disconnect the connector.

To enable hydraulic-powered disconnection, the operating stem has an internal, cylindrical cavity in which is located a fixed piston connected to a fixed rod going through the top end of said operating stem and secured to said body at the top wall of said internal cavity, the top and bottom ends of said internal cylindrical cavity of said operating stem being connected to hydraulic fluid lines.

Another special feature of the invention is that the top end of said inclined ramp of each dog terminates in a notch operable to catch said pin at the end of its travel, to prevent its dropping back.

BRIEF DESCRIPTION OF THE DRAWINGS

A specific embodiment of the invention will now be described with reference to the appended drawings in which:

FIG. 10 is a detail of an embodiment wherein a safety valve manifold has been provided for the case of a rupture of the hydraulic supply lines;

and FIG. 11 is a partly symbolic diagram illustrating the operation of the safety manifold of FIG. 10.

DESCRIPTION OF THE PREFERRED EMBODIMENTS

Figure 1:
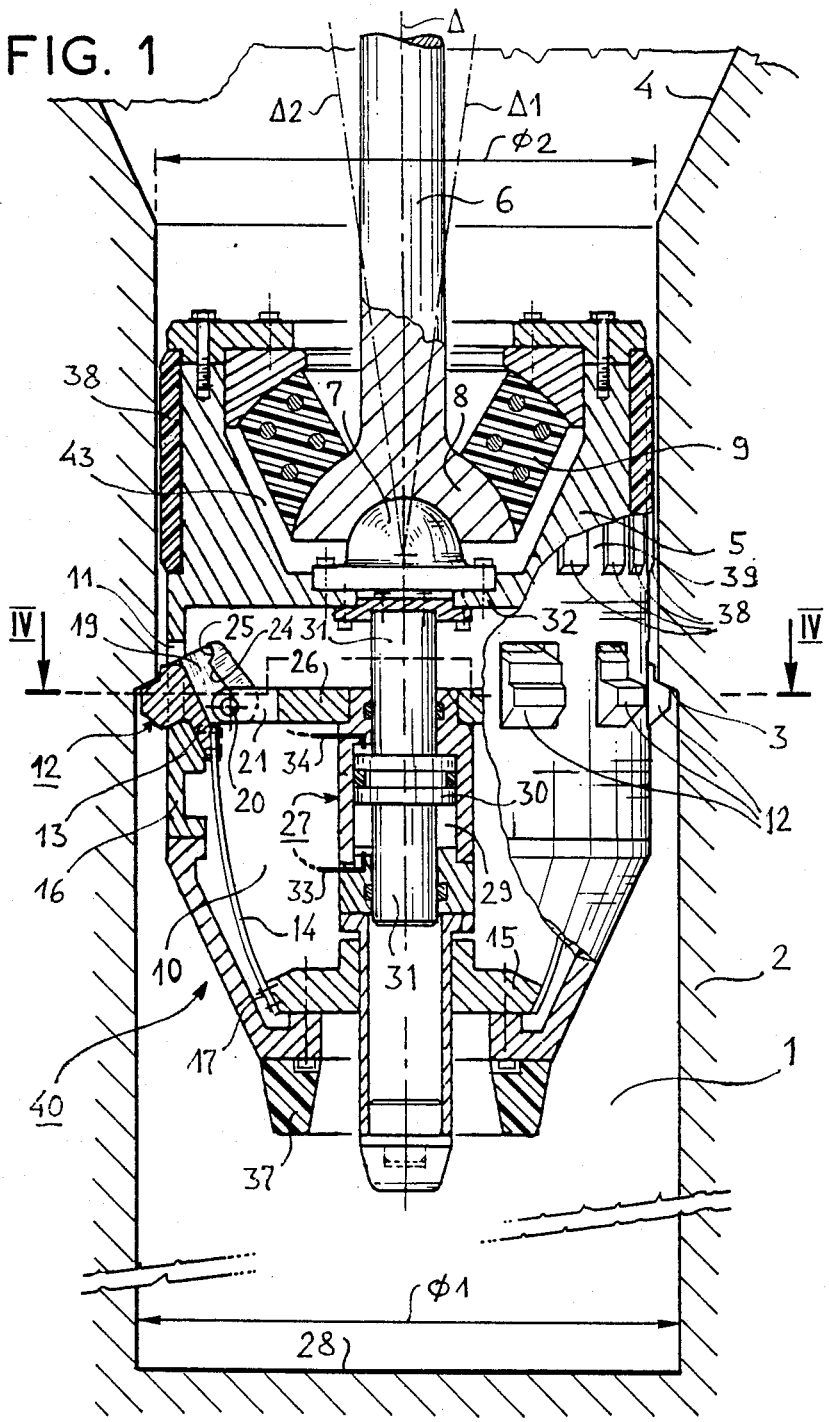
FIG. 1 is a cut away view of a mechanical connector according to the invention when connected.

Referring to FIGS. 1 through 4, the male mechanical connector 40 is represented in a position where it is anchored in its female receptacle, with the dogs extended and the tether tensioned. The female receptacle 1 has a circular metal wall 2, securely anchored to the seabed. The female receptacle 1 comprises a cylindrical hole, $0_1$ in diameter at the bottom, which hole is necked to a lesser diameter $0_2$ towards the top, such that an internal annular shoulder 3 is established between the two latter diameters. The mouth of the female receptacle 1 is flared out to form an insertion cone 4.

The male mechanical connector 40 designed to mate with said female receptacle 1 comprises a cylindrical body 5 of axis Δ, connected to a line 6, being for example the tether of a tension-leg offshore oil production platform, via means allowing a certain angular freedom or "swing" of the tether in relation to the connector itself, represented by the axes $\Delta_1$and $\Delta_2$.

Said connection means include a hemispherical ball 7 and socket 8 joint, the socket 8 being on the end of the line 6. A high-strength bushing 9 of a reinforced elastic material transmits the pulling force from the line 6 to the body 5 of the connector 40. Said means are located within an upper cavity 43 of the male connector 40.

The bottom of body 5, below the just-described ball and socket joint assembly, features an internal bottom cavity 10 whose cylindrical wall is provided with a circular series of openings 11 opening radially to the outside.

Figure 2:
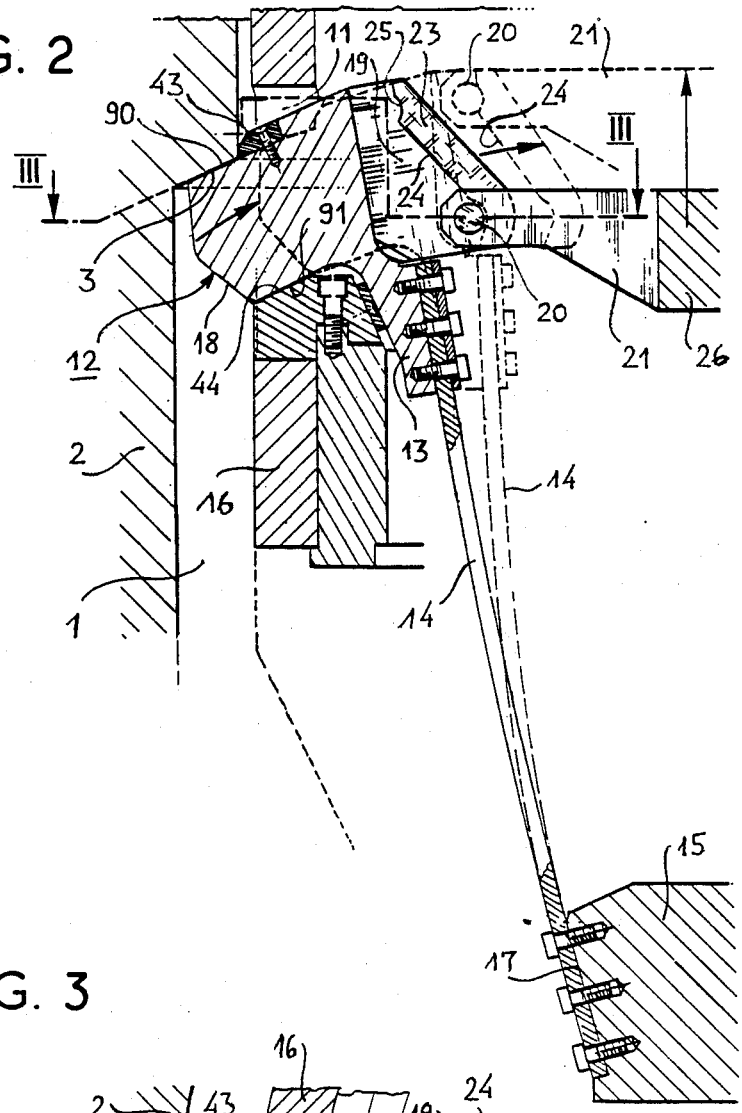
FIG. 2 is a partial cut away view showing a detail of FIG. 1.

Each opening 11 receives a dog 12 having a top surface 90 and a bottom surface 91 and a tail-like bottom extension 13 attached to the top part of a spring leaf 14 whose bottom end is attached, in the bottom of cavity 10, to the side wall of a circular plate 15, FIG. 2.

Unless prevented, the spring leaf 14 urges the dog 12 outwardly through opening 11, as shown in FIGS. 1 and 2—in which position the tail 13 of said dog is radially stopped by the wall 16 of the body 5 and the bottom surface 91 of said dog bears against the bottom 44 of opening 11. In order to allow the spring leaf 14 to urge the dog 12 radially outward, the side wall 17 of the circular plate 15, to which the bottom ends of all the leaf springs 14 are fastened, is made oblique.

In mated configuration as illustrated in FIGS. 1 through 4, the dogs thus project radially out of the external cylindrical wall of the connector such that the circumscribed circle about the ends of all the dogs has a diameter between $0_1$ and $0_2$.

Figure 3:
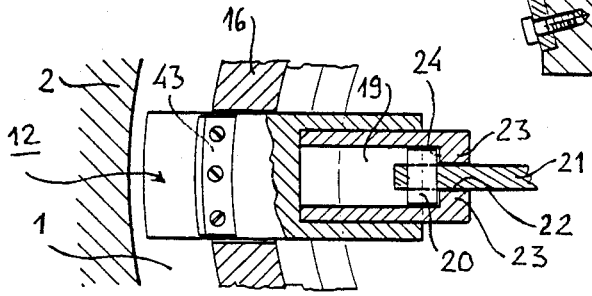
FIG. 3 is a cut away view taken along III—III of FIG. 2.
Figure 4:
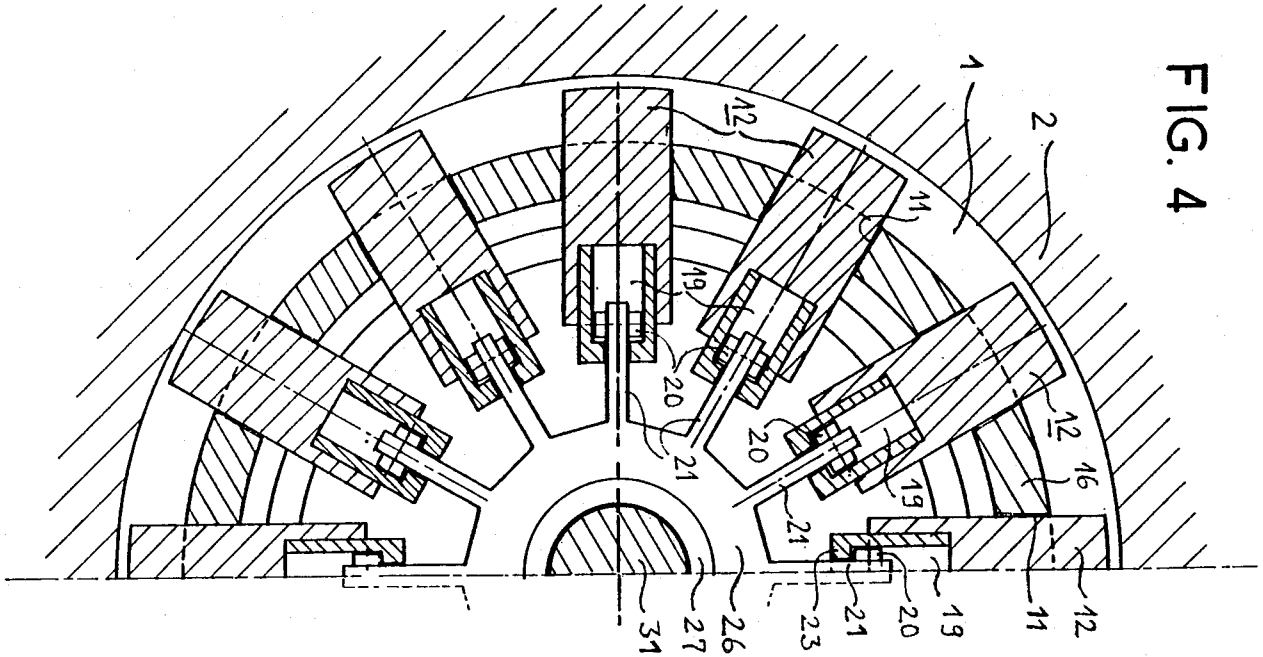
FIG. 4 is a half cross-sectional view taken along line IV—IV of FIG. 1.

The outer end of the dogs has an inclined outer surface 18 enabling their automatic retraction during penetration of the connector in its female receptacle, by the pushing of said inclined surface 18 against the conical wall 4 of the receptacle mouth. Accordingly, the sloping direction of said inclined surface is made such that one moves away from the axis Δ of the connector in moving up the slope of said surface 18. As can be seen from FIGS. 3 and 4, the dogs comprise a cutout 19 accommodating a pin 20 connected to an arm 21 passing through a slot 22 in the back wall 23 of the dog. This cutout 19 allows the dog 12 to move freely backwards at the time of connector 40 penetration into the female receptacle 1, leaving a space 24 behind the pin 20, between the pin and the dog's back wall 23. This is most readily apparent in FIG. 6—the enlarged detail illustration showing the position of the parts when the dogs are pushed back as the connector 40 penetrates into the female receptacle. The same configuration of the parts in the overall connector is seen from the outside in FIG. 5. For practical purposes of manufacture, the dogs, as can be seen in FIGS. 3 and 4, are made of two assembled parts.

The back surface 24 of the cutout 19 in each dog 12, as best seen in FIGS. 1, 2, 6, 7 and 9, is inclined from the vertical—inclined in other words with respect to the axis Δ, thus forming an oblique ramp sloping up and away from the axis Δ. The top of this ramp 24 ends in a notch 25. The ramp 24 acts as a cam in cooperation with the pin 20 which includes means for vertical movement parallel to the axis Δ enabling retraction of the dogs 12 for connector disconnection.

To enable vertical displacement of all the pins 20 simultaneously, the arms 21 are made as extensions of a plate 26 attached to an axial operating stem 27. This axial operating stem 27 extends through the circular plate 15 and projects, when in its bottommost position represented in FIGS. 1 and 5, beyond the bottom end of the connector 40. Thus, as the connector 40 bottoms in the receptacle 1 following slackening of the tether, string or line 6, the operating stem 27 slides up and the dogs 12 retract due to their pins' 20 bearing against the dogs' oblique ramps 24.

At the end of this upward travel of the stem 27, the pins 20 catch in the notches 25 and are locked against descent.

Figure 7:
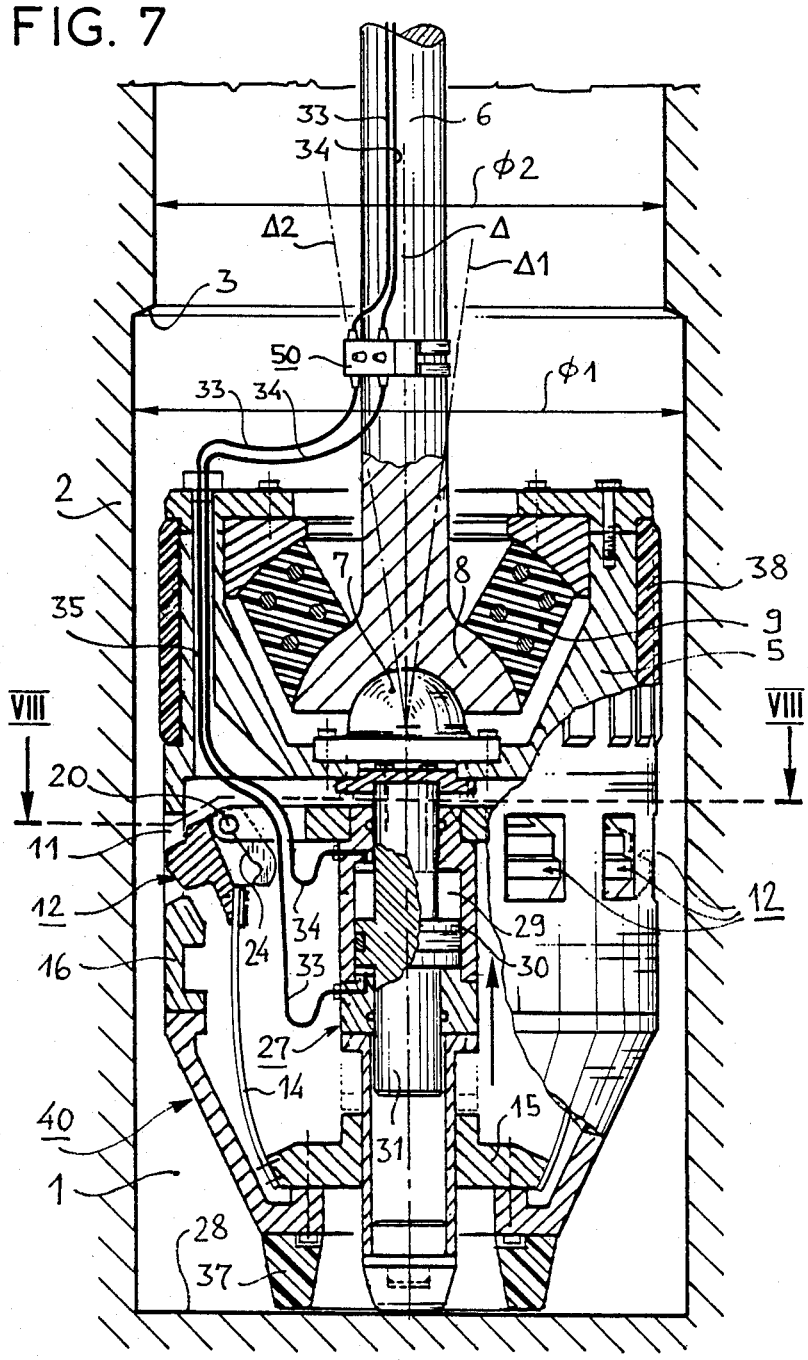
FIG. 7 is a cut away view of the connector in a position corresponding to mechanical disconnection.
Figure 8:
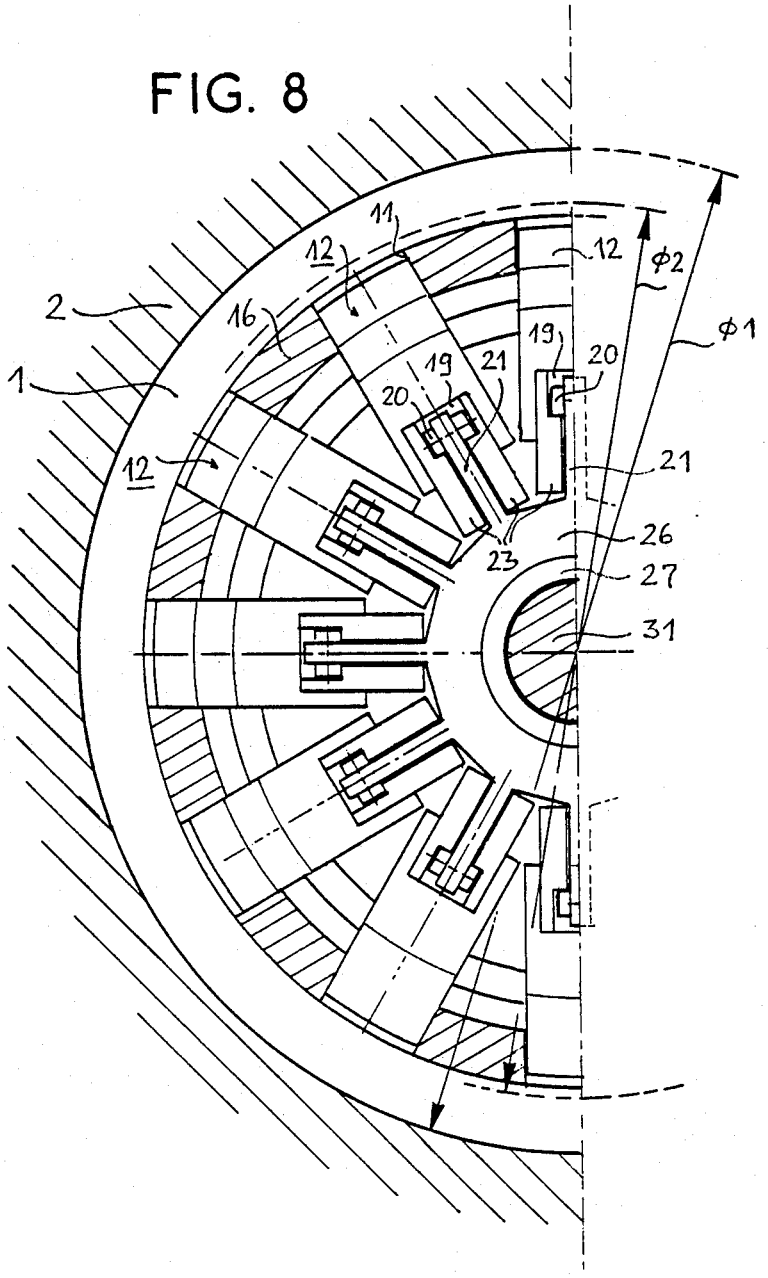
FIG. 8 is a half cross-section along line VII—VIII of FIG. 1.

It is then possible, with the dogs retracted, to pull up the line 6. FIG. 7 shows the connector 40 bearing upon the bottom 28 of the female receptacle, with its operating stem 27 pushed up and the dogs 12 retracted.

Figure 9:
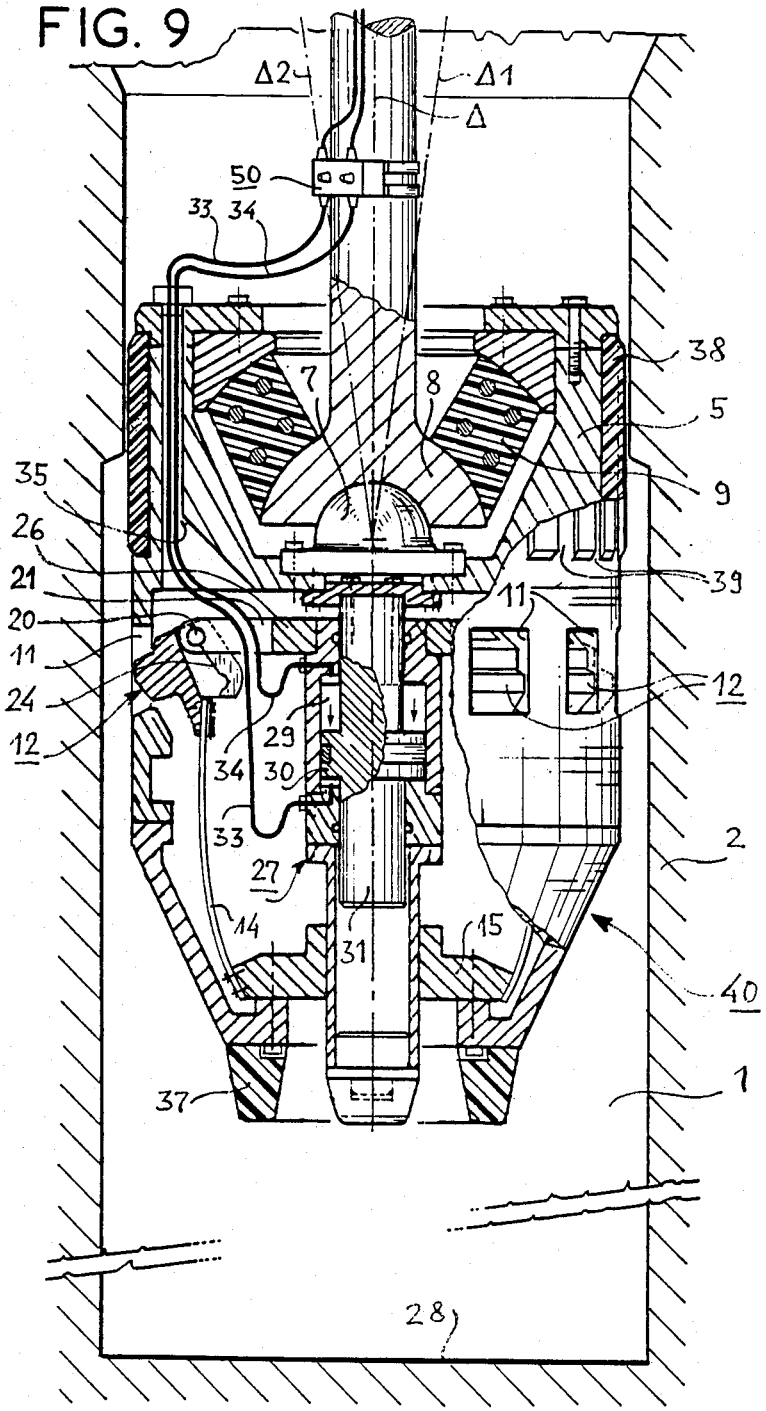
FIG. 9 is a cut away view of the connector in a position corresponding to a hydraulic disconnection.

The operating stem 27 can also be actuated by hydraulic means, as represented in FIG. 9. To this end, the stem, as shown in FIGS. 1, 7 and 9 is given an internal cylindrical cavity 29 housing a fixed piston 30 connected to a fixed stem 31 passing through the movable operating stem 27 and fastened to the cylindrical body 5 of the connector, at the top wall 32 of the lower internal cavity 10.

The fixed piston 30 separates the cylindrical internal cavity 29 of the movable operating stem 27 into two chambers supplied with hydraulic fluid via fluid-tight hoses 33 and 34 passing through the body 5 in a channel 35 and running to the surface alongside the tether 6.

It is thereby possible to retract the dogs 12, disconnect the connector and pull up the tether string under hydraulic power, by sending hydraulic fluid down hose 34 after having slackened and slightly lowered the tether.

The bottom end of the connector 40 has damping means 37.

Also, ribs 38, separated by open channels 39 are provided around the outside of the top part of connector body 5 (FIG. 5) for greater slidability and for evacuation of water when the connector 40 penetrates the female receptacle 1.

Figure 5:
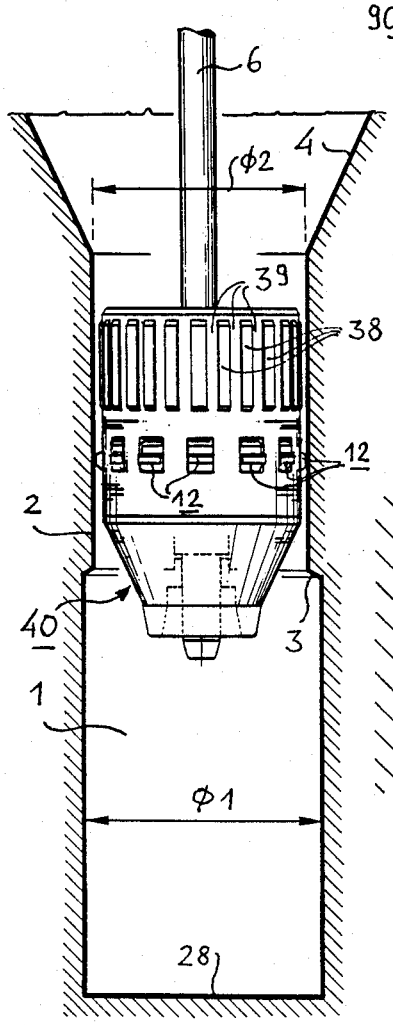
FIG. 5 is an external view of the mechanical connector being inserted into the female receptacle.
Figure 6:
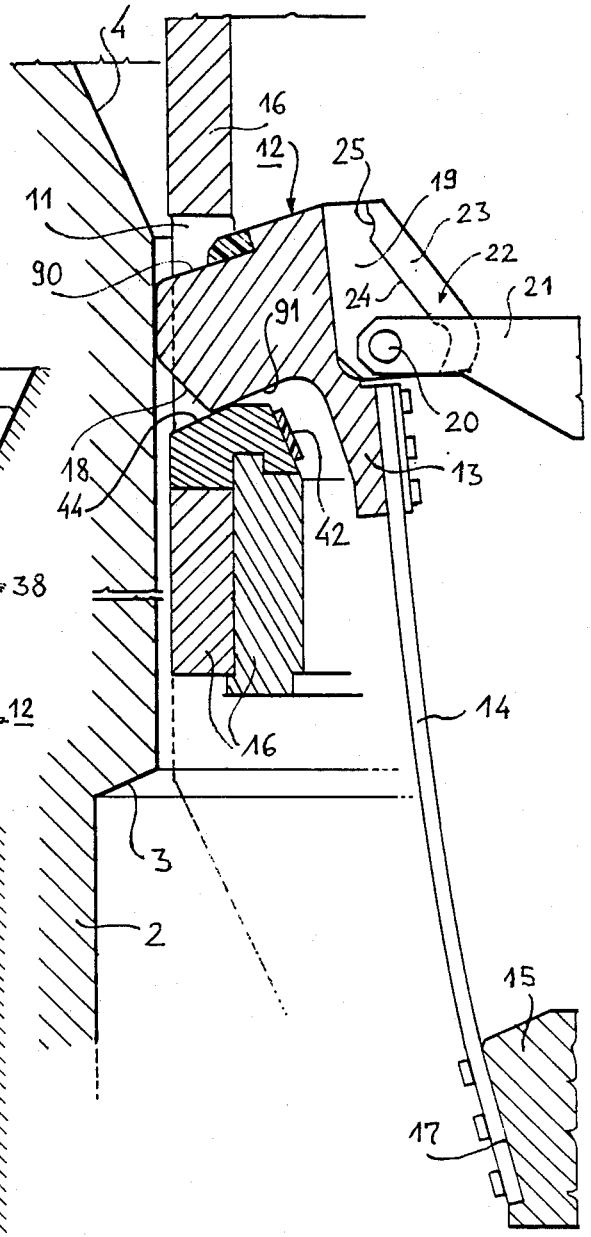
FIG. 6 is an enlarged cut away view showing the position of a dog within the connector at the time of insertion represented in FIG. 5.

As previously stated, FIGS. 5 and 6 represent the connector during the mating phase, with the dogs retracted, as they are at the beginning of the penetration phase due to the pressure of the dogs' inclined surface 18 against the flared wall or cone 4 of the receptacle mouth. The descent continues up to the point when the dogs arrive at the level where the female receptacle has a diameter of $0_1$, the dogs rubbing against the receptacle's wall of diameter $0_2$, as they are urged outwards by the spring leafs 14. As soon as they reach the level of $0_1$, the dogs extend to a maximum, such that the tail 13 hits the wall 16, which can be equipped with a series of damping pads 42, FIG. 6 for smoother operation. Likewise, the top surface of the dogs can be provided with cushioning means 43, FIG. 2. The tether string is then pulled up and the dogs—specifically the dogs' top surface 90—stop against shoulder 3. This position, with the connector mated and the tether tensioned, is illustrated in FIGS. 1 through 4. To ensure the dogs stay extended when the connector is locked and the line 6 tensioned, the dogs' top 90 and bottom 91 surfaces, which at this point bear respectively against the shoulder 3 and the bottom surface 44 of the opening 11, form a slight angle between them, of approximately 3°, open toward the outside of the connector. This feature is particularly advantageous in the event a spring leaf 14 should fail, through rupture or fatigue.

FIG. 7 illustrates disconnection by pressure against the bottom 28 and FIG. 9 illustrates disconnection by hydraulic pressure exerted in the upper chamber of the cylindrical cavity 29, causing the movable axial operating stem 27 to rise, the piston 30 remaining stationary.

The light broken line drawing portion in FIG. 2 shows the position of the dog 12, the spring leaf 14 and the pin 20 when the dogs are being retracted, not automatically as during connection, but, during disconnection, by upward motion of the operating stem 27 due either to bottoming of the connector (FIG. 7) or hydraulic power (FIG. 9).

The connector according to the invention is thus mechanically extremely simple and allows reliable, automatic connection without pushing against the bottom and without the need of hydraulic power.

Disconnection can be accomplished in two ways: either mechanically or hydraulically, giving added reliability. Moreover, the male connector 40 to line 6 ball-and-socket joint assembly 7, 8 and 9, allowing an angular movement by $\Delta_1$ to $\Delta_2$ of the axis $\Delta$ of line 6 relative to the connector axis, being located above the mechanical system of the connecting/disconnecting means, ie. above the internal cavity 10, in a higher internal cavity 43, affords a greater angular clearance than the connector of the previously mentioned French prior art document No. 2 573 831.

In some cases, such as in the event of rupture of the fluid supply hoses 33 and 34 running along the tether line 6, or of a faulty connection operation for example, it may be necessary for divers or some automatic underwater machine to carry out the dogs retraction or extension procedure from the seabed. For such case, a safety manifold 50 can be provided, installed as shown in FIG. 10 near the connector. The desired maneuvering can thus be accomplished merely by connecting an emergency hydraulic supply to the manifold.

The safety manifold 50 is secured to the bottom of the line, near the connector, with pipe clamps 62 and is interposed in the hoses 33 and 34. It is equipped with two self-sealing, ie. "valved" fittings 53 and 54 enabling connection of the emergency hydraulic supply couplings.

FIG. 11 shows the various components of the safety manifold 50 drawn in symbolic form, in a box drawn with light hyphenated lines 70.

The manifold basically comprises a 3-way A, S and B, springcentered three-position, directional control valve 61 with a hydraulic pilot, centered by springs 71 and 72. The self-sealing fittings 53 and 54 containing valves 55 and 56 are connected to way S by opposite acting check valves 57 and 58; they are further connected via two other opposite acting check valves 59 and 60 to fluid leakage drain lines 73, 74 and 75; lastly, the self-sealing fitting 53 is connected to the pilot inlet port 76 of the overall directional control valve 61 to control rightward sliding of the valve spool. Ways A and B are connected to hoses 33 and 34 whose outlets are respectively connected to the bottom chamber **29*a* and the top chamber 29*b* of the cylindrical cavity 29 of the axial operating stem 27**.

In normal operation, in the absence of any anomaly or rupture of hoses 33, 34 along the tether 6, control valve 61 is set in the center position shown in the figure and hydraulic fluid is supplied from the surface.

In the event of a malfunction and if it becomes impossible to hydraulically supply the chambers **29*a* and 29*b* from the surface, an emergency supply brought by a diver or underwater service machine, having couplings 51 and 52 is used. Said couplings 51 and 52 respectively connect to the self-sealing fittings 53 and 54, opening valves 55 and 56 as well as 78 and 79. To retract the dogs 12, and accordingly to raise the operating stem 27, it is necessary to supply the top chamber 29*b*. This is done by pressurizing the emergency supply line connected to coupling 51. The directional valve spool is moved to the right by applying pressure to the pilot inlet 76, thus connecting way B to the plugged bore Z, way S to the oblique bore Y and way A to the direct bore X. Valve 57 is opened and fluid enters chamber 29*b* through way S, oblique bore Y and the bottom section of hose 34. The oil contained in bottom chamber 29*a* is evacuated through the bottom section of hose 33, bore X and way A and discharged to the sea through the break in hose 33 at 80. Any leaks as may occur from the directional valve are discharged through lines 73, 74 and 75 and valve 60, and thereafter go to coupling 52**.

Cancelling the pressure in the line supplying the coupling 51 allows the directional valve 61 spool to resume its center rest position, thanks to the action of springs 71 and 72.

Conversely, to supply the bottom chamber **29*a*, so as to lower the operating stem 27, the coupling 52 must be supplied with hydraulic fluid under pressure, which has the effect of moving the directional valve 61 spool to the left, to make way S communicate with said bottom chamber via oblique bore $Y_1$ and the bottom section of hose 33. The top chamber 29*b* empties through bore $X_1$ and hose 34 and discharges to the sea at the break. Any leakage from the directional valve discharges through lines 73, 74 and 75, valve 59 and coupling 51**.

We claim:

1. A mechanical connector for securing a tension-leg platform tether to an anchoring point, said connector consisting of a male connector linked to the tether and penetrating a female receptacle forming part of the anchoring point and having a top rim and a necked upper portion forming a circular internal shoulder, said male connector including a cylindrical body comprising means for connection to said tether, the improvement wherein said cylindrical body comprises a cylindrical wall defining an internal cavity, means forming a circular series of openings within the cylindrical wall to the outside, a dog receivable in each opening, said dog having at least a top face and a bottom face, said dog being operable to assume a first, extended position radially abutting the wall of said body and bearing upon the bottom surface of said wall at said opening, in which position said dog projects radially beyond the cylindrical outside wall of the male connector and elastic, radially outthrusting means for urging said dog radially beyond the cylindrical outside wall, each dog having an external inclined face sloping such that one moves away from the male connector's centerline in moving up said inclined face, said dog being operable to assume a second position, of automatic retraction during connector descent, by said inclined face of said dog bearing against the top rim of the female receptacle, each dog further comprising an inclined ramp acting as a cam and a drive pin operatively engaging said ramp whereby vertical upward motion, by said pin's pushing and sliding against said ramp, causes the dog to retract, and means connected to all the pins for enabling their common vertical displacement.

2. Mechanical connector according to claim 1, wherein the radially outthrusting elastic means for each dog include a spring leaf located inside the internal cavity of the connector body and having a top attached to a "tail" of the dog and having a bottom end attached to the cylindrical body at the bottom of said cavity.

3. Mechanical connector according to claim 1, wherein the means for enabling vertical displacement of said pins include an axial operating stem going through said body at the bottom of the cavity and having a bottom projecting beyond the bottom end of the male connector, and said stem having a top end mechanically attached to said pins by hub and spoke-like connecting means operating on all the pins simultaneously.

4. Mechanical connector according to claim 3, wherein the operating stem has an internal, cylindrical cavity, a fixed piston connected to a fixed rod going through the top end of said operating stem and secured to said body at the top wall of said internal cylindrical cavity, said internal cylindrical cavity having top and bottom ends and said operating stem being connected via said top and bottom ends to hydraulic fluid lines.

5. Mechanical connector according to claim 1, wherein said inclined ramp of each dog has a top end which terminates in a notch operable to catch said pin at the end of its travel, to prevent its dropping back.

6. Mechanical connector according to claim 1, wherein said tether to connector body connecting means comprise elastic connecting means between a line and the male connector body and a ball and socket joint allowing relative angular motion between the tether and the male connector, and wherein said connecting means is located above said internal cavity.

7. Mechanical connector according to claim 4, further comprising a safety valve manifold interposed in said hydraulic lines, near the male connector, said safety manifold consisting of a directional control valve, check valves and two inlets whereby a connection can be made between said safety manifold and an emergency hydraulic supply, enabling controlled hydraulic fluid feed to either said top end of said internal cavity or said bottom end of said internal cavity.

8. Mechanical connector according to claim 1, wherein the top face and the bottom face of the dogs form a small angle with respect to each other, on the order of a few degrees, opening toward the outside of the male connector.

* * * * *